US007878240B2

(12) United States Patent
Garcia

(10) Patent No.: US 7,878,240 B2
(45) Date of Patent: Feb. 1, 2011

(54) DOWNHOLE SWAGING SYSTEM AND METHOD

(75) Inventor: David Alan Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 107 days.

(21) Appl. No.: 12/133,900

(22) Filed: Jun. 5, 2008

(65) Prior Publication Data

US 2009/0139732 A1 Jun. 4, 2009

Related U.S. Application Data

(60) Provisional application No. 60/942,018, filed on Jun. 5, 2007.

(51) Int. Cl.
*E21B 23/00* (2006.01)
*E21B 23/02* (2006.01)
*E21B 43/10* (2006.01)

(52) U.S. Cl. ..... 166/207; 166/382; 166/206

(58) Field of Classification Search ..... 166/206, 166/207, 382; 72/112
See application file for complete search history.

(56) References Cited

U.S. PATENT DOCUMENTS 3,191,680 A * 6/1965 Vincent ..... 166/387
4,311,194 A 1/1982 White
6,352,112 B1 3/2002 Mills
6,390,198 B2 5/2002 Brooks et al.
6,450,261 B1 9/2002 Baugh
6,547,006 B1 4/2003 Kuck et al.
6,739,398 B1 5/2004 Yokley et al.
6,866,100 B2 3/2005 Gudmestad et al.
6,920,927 B2 * 7/2005 Hirth ..... 166/206
7,048,065 B2 5/2006 Badrak et al.
7,083,005 B2 8/2006 Galloway et al.
7,090,005 B2 * 8/2006 Smith et al. ..... 166/206
7,114,559 B2 10/2006 Sonnier et al.
7,117,941 B1 * 10/2006 Gano et al. ..... 166/207
7,124,826 B2 10/2006 Simpson (Continued)

FOREIGN PATENT DOCUMENTS

CA 2 529 480 9/1997

(Continued)

OTHER PUBLICATIONS

Sas-Jaworsky, et al. "Development of Composite Coiled Tubing for Oilfield Services." Society of Petroleum Engineers, SPE 26536. 68th Annual Technical Conference and Exhibition of the Society of Petroleum Engineers, Houston, TX Oct. 3-6, 1993.

*Primary Examiner*—Shane Bomar
*Assistant Examiner*—Sonya Bible
(74) *Attorney, Agent, or Firm*—Cantor Colburn LLP

(57) ABSTRACT

A downhole swaging system includes, a tubular having an area of strength with a different resistance to swaging as compared to areas of the tubular outside of the area of strength, and a swaging tool. The swaging tool has a first swage, and a second swage with an adjustable swaging dimension, the second swage is in functional communication with the first swage such that the adjustable swaging dimension is adjusted in response to the first swage encountering a change in resistance to swaging.

14 Claims, 6 Drawing Sheets

U.S. PATENT DOCUMENTS

| | | | | |
|---|---|---|---|---|
| 7,128,146 | B2 * | 10/2006 | Baugh et al. | 166/206 |
| 7,159,661 | B2 | 1/2007 | Restarick et al. | |
| 7,172,021 | B2 | 2/2007 | Brisco et al. | |
| 7,174,964 | B2 | 2/2007 | Cook et al. | |
| 7,195,064 | B2 | 3/2007 | Cook et al. | |
| 7,198,100 | B2 | 4/2007 | Cook et al. | |
| 7,222,669 | B2 * | 5/2007 | Sonnier et al. | 166/206 |
| 7,549,469 | B2 * | 6/2009 | Garcia | 166/206 |
| 7,549,480 | B2 * | 6/2009 | Lohbeck | 166/383 |
| 2003/0047323 | A1 * | 3/2003 | Jackson et al. | 166/380 |
| 2004/0168796 | A1 * | 9/2004 | Baugh et al. | 166/207 |
| 2005/0039910 | A1 * | 2/2005 | Lohbeck | 166/242.1 |
| 2005/0161213 | A1 * | 7/2005 | Sonnier et al. | 166/207 |
| 2005/0161229 | A1 * | 7/2005 | Doane et al. | 166/382 |
| 2005/0230102 | A1 * | 10/2005 | Cook et al. | 166/206 |
| 2005/0263294 | A1 | 12/2005 | Braddick | |
| 2006/0124295 | A1 | 6/2006 | Maguire | |
| 2006/0185857 | A1 | 8/2006 | York et al. | |
| 2006/0225879 | A1 * | 10/2006 | Gano et al. | 166/207 |
| 2006/0237188 | A1 | 10/2006 | McMahan | |
| 2008/0047704 | A1 * | 2/2008 | Tom et al. | 166/118 |

FOREIGN PATENT DOCUMENTS

| | | |
|---|---|---|
| GB | 2 365 898 | 2/2002 |
| WO | WO 2006113775 | 10/2006 |

* cited by examiner

DOWNHOLE SWAGING SYSTEM AND METHOD

BACKGROUND OF THE INVENTION

Downhole tools such as hangers and packers include such devices as slips and seals to structurally fix one tubular to another or to seal one tubular to another, for example. Loads applied during the setting of such tools are important to successful setting of the tools. Passing a swaging tool through the hanger or packer is a common method of setting such tools. At times, however, the setting forces from the swaging process are inadequate to reliably set the tool and consequently the set eventually fails. The art, therefore, would be receptive of systems that more reliable set such tools.

BRIEF DESCRIPTION OF THE INVENTION

Disclosed herein is a downhole swaging system. The system includes, a tubular having an area of strength with a different resistance to swaging as compared to areas of the tubular outside of the area of strength, and a swaging tool. The swaging tool has a first swage, and a second swage with an adjustable swaging dimension, the second swage is in functional communication with the first swage such that the adjustable swaging dimension is adjusted in response to the first swage encountering a change in resistance to swaging.

Further disclosed herein is a method of swaging a tubular. The method includes, positioning an adjustable dimension two staged swaging tool within a tubular, and adjusting at least once a dimension of a second stage of the adjustable dimension two staged swaging tool in response to encountering a change in resistance to swaging of the tubular with a first stage of the adjustable dimension two staged swaging tool.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
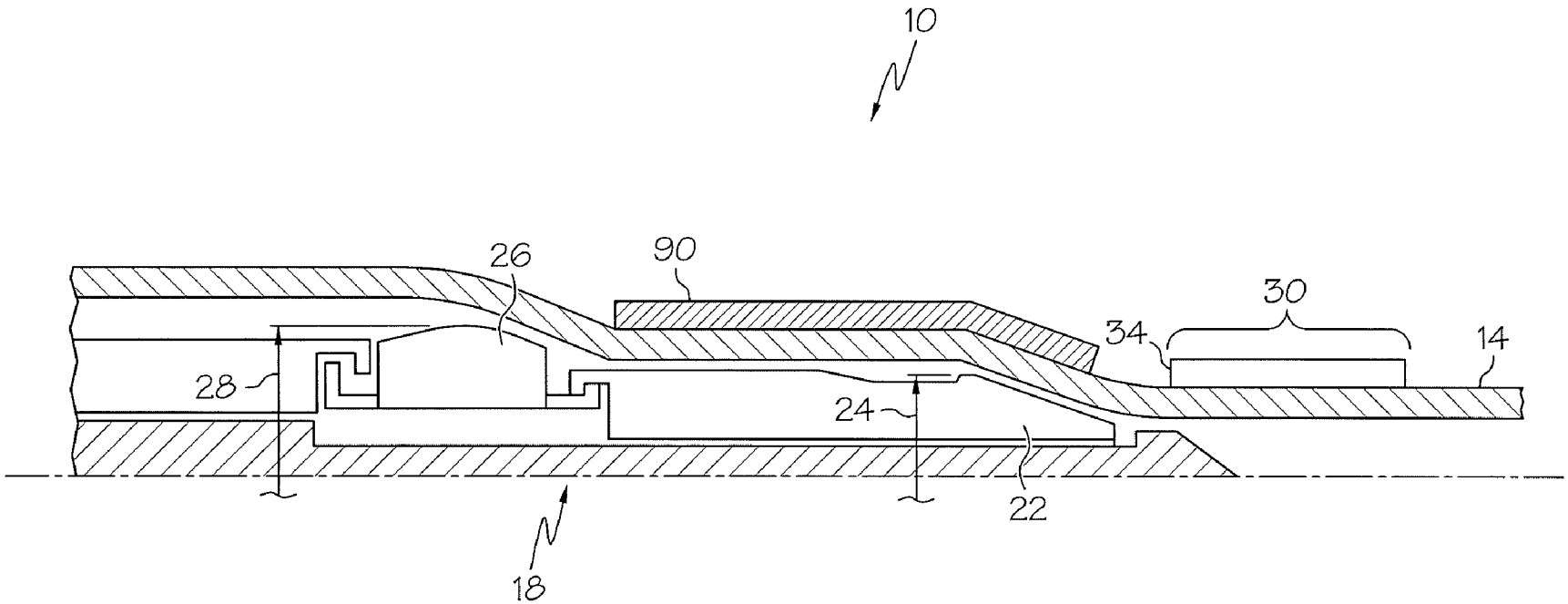
FIG. 1 depicts a partial cross sectional view of the downhole swaging system disclosed herein.
Figure 2:
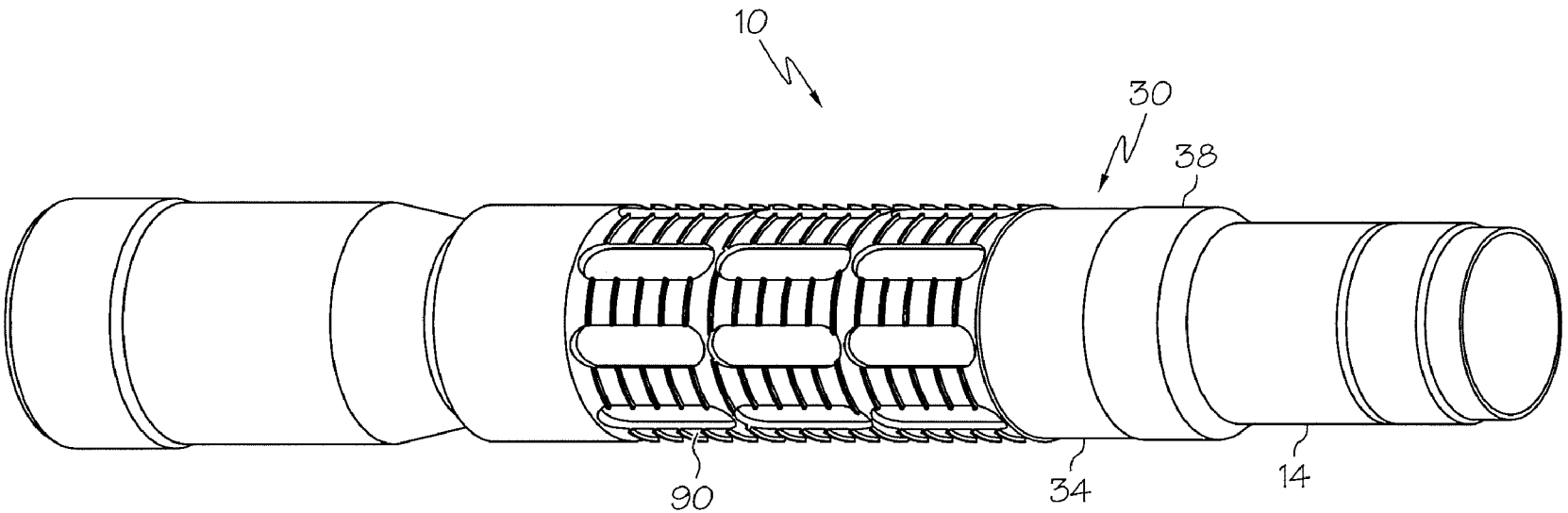
FIG. 2 depicts a perspective view of the downhole swaging system of FIG. 1.

Referring to FIGS. 1 and 2, an embodiment of the downhole swaging system 10 disclosed herein is illustrated. The swaging system 10, among other things, includes a swagable tubular 14, depicted herein as a liner made of a rigid material such as steel, for example, and a swaging tool 18. The swaging tool 18 has a first swage 22 that, in this embodiment, has a fixed first swaging dimension 24, and a second swage 26 that has an adjustable second swaging dimension 28. It should be noted that alternate embodiments might have a first swage that is adjustable such that the first swage would have an adjustable swaging dimension that could at times exceed the swaging dimension 24. The tubular 14 has an area of strength 30, depicted in this embodiment as a load ring 34 positioned coaxially with the tubular 14 and radially outwardly of the tubular 14. The area of strength 30 is configured such that the swaging tool 18 encounters an increase in resistance to swaging as the first swage 22 begins to swage the area of strength 30. This increase in resistance to swaging creates a corresponding increase in a force necessary to continue to swage the area of strength 30 with the first swage 22. The swaging tool 18 is configured to increase the second swaging dimension 28, of the second swage 26, in response to an increase in resistance encountered by the first swage 22. The swages 22, 26 of this embodiment are circular such that the swaging performed by the swages 22, 26 increase the dimension of the tubular 14 diametrically. Alternate embodiments, however, may use swages with noncircular shapes such as oval, elliptical or octagonal, for example.

The swaging tool 18 is further configured such that the second swaging dimension 28 is reducible in response to a reduction in swaging resistance encountered by the first swage 22. Thus, as the first swage passes beyond the area of strength 30 the second swage 26 is dimensionally reduced to allow the second swage 26 to pass through the area of strength 30 without expanding the area of strength 30. An adjustable swaging tool capable of altering a swaging shape in response to encountering obstructions with the tool is known in the industry. Such an adjustable swaging tool is disclosed in U.S. Pat. No. 7,128,146 (hereinafter '146), to John L. Baugh, the entire contents of which is incorporated herein by reference.

The load ring 34 used to create the area of strength 30 can be axially fixed to the tubular 14 by a radially flexible member 38 such as rubber as is shown herein (FIG. 2). The flexibility of the flexible member 38 allows for the expansion of the tubular 14 in the area of strength while maintaining the axial location of both the flexible member 38 and the load ring 34. The area of strength 30 can be axially fixed to the tubular 14 by other methods as long as the method retains the axial position of the area of strength 30 after the swaging tool 18 has passed therethrough. Some such methods will be described with reference to FIGS. 3 and 4 below.

Figure 3:
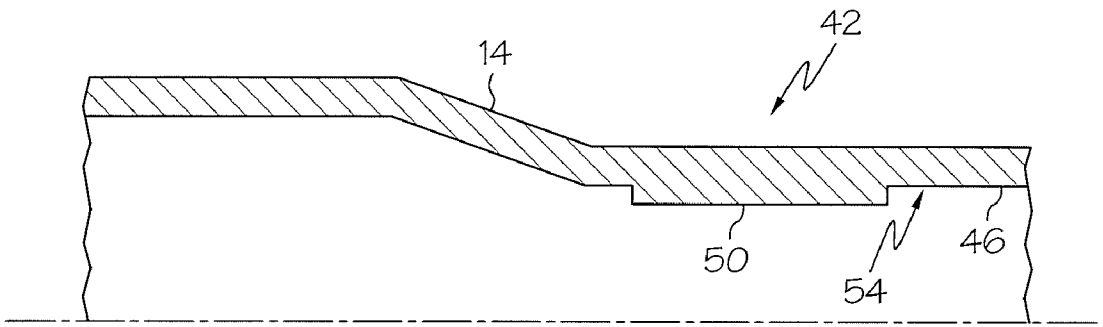
FIG. 3 depicts a partial cross sectional view of a tubular disclosed herein.
Figure 4:
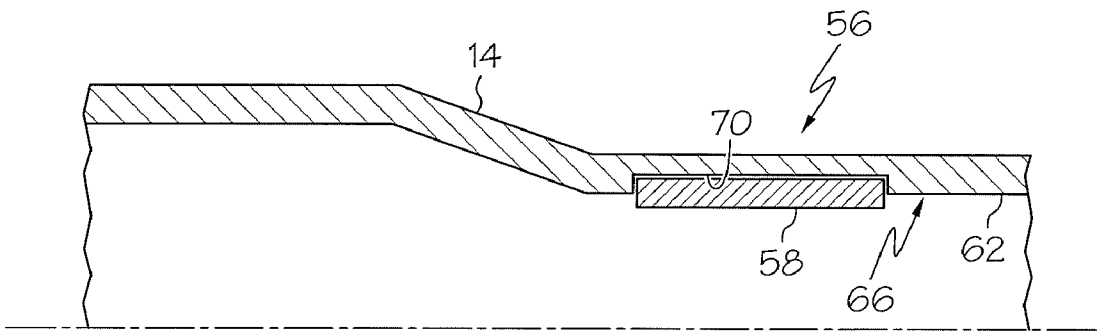
FIG. 4 depicts a partial cross sectional view of an alternate tubular disclosed herein.

Referring to FIGS. 3 and 4, alternate embodiments of the tubular 14 are disclosed. The tubular 14, of FIG. 3, includes an area of strength 42 that comprises a wall 46 of the tubular 14 with an increased thickness 50. The increased thickness 50 in this embodiment is on an inner surface 54 of the wall 46. Alternate embodiments could have the increase in thickness on an outer surface, or both an inner and an outer surface, for example. The tubular 14, of FIG. 4, includes an area of strength 56 that comprises a load ring 58 positioned radially inwardly of a wall 62 of the tubular 14. The wall 62 has an inner surface 66 with a perimetrical recess 70 formed therein in which the load ring 58 is positioned. The recess 70 axially locks the load ring 58 to the wall prior to, during and after the swaging tool 18 has passed therethrough. Although the embodiment of the tubular 14 of FIG. 4 has the perimetrical recess 70 on the inner surface 66 alternate embodiments could position a perimetrical recess on an outer surface to locationally lock a load ring to the outer surface thereof. Additionally, alternate embodiments of the area of strength 30, 42, 56 could be formed by positioning a downhole tool along an outer surface of the tubular 14. Such a downhole tool would need to dimensionally expand to allow passage of the swaging tool 18 therethrough. In such an embodiment the downhole tool may be designed such that the downhole tool is destroyed as the swaging tool 18 passes thereby. Still other areas of strength may be created with no geometric changes to the tubular 14 or surrounding area thereat. Such an area of strength might use modified material properties of the tubular 14 only in the area of strength to create the area of strength. For example, through heat treating or work hardening, a section of the tubular can be made to have an increased resistance to swaging in the specific heat treated or work hardened section only.

Figure 5:
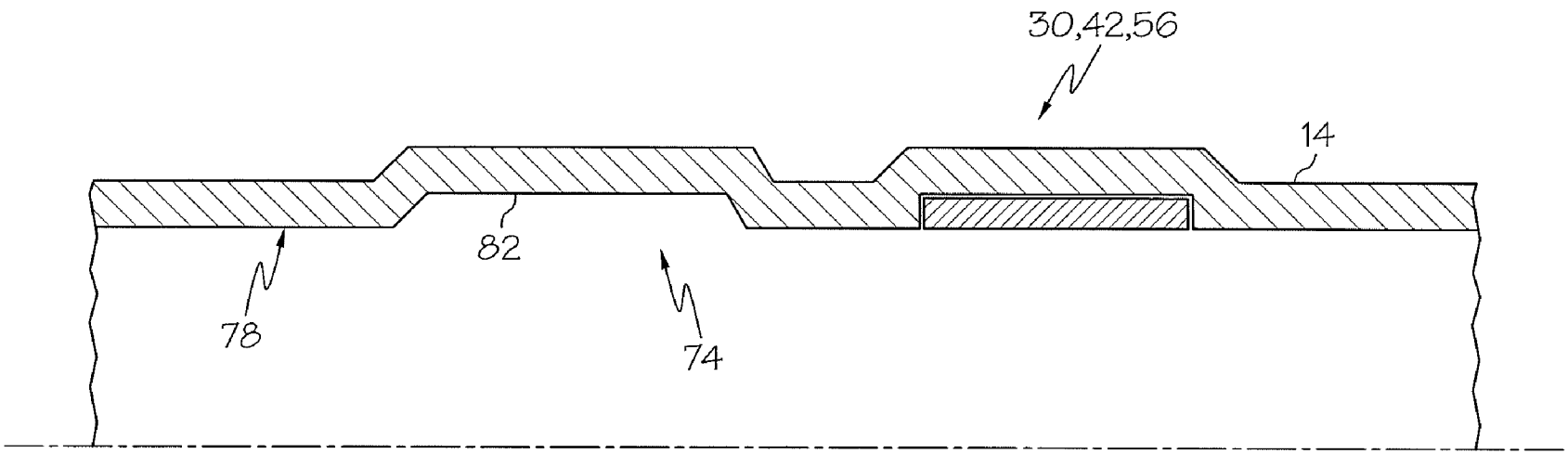
FIG. 5 depicts a partial cross sectional view of a tubular after the swaging tool has passed therethrough.

Referring to FIG. 5, a profile 74, of an inner surface 78 of the tubular 14 may be present after the swaging tool 18 has passed therethrough. The profile 74 may have a perimetrical recess 82 in the inner surface 78. A length of the recess 82 may be similar to a length of the area of strength 30, 42, 56 since the area of strength 30, 42, 56 caused the swaging tool 18 to form the recess 82. The recess 82 can be used to receive a retrieving tool, a hanger or other tool, for example, that needs a recess with which to interface. The profile 74 present on the inner surface 78 may be the same profile regardless of which of the area of strength 30, 42, 56 is employed in the swaging system 10.

Referring again to FIGS. 1 and 2, the increased dimension 28 of the second swage 26 can be used to improve the performance of a tool, such as a hanger or a packer, for example, placed at the location of cladding 90, which is in axial alignment with the location of the second swage dimension 28. By positioning the tool, at the location of the cladding 90, engagement of seals or slips can be improved by the extra dimensional expansion provided by the swaging system 10 as compared to not using the swaging system 10. This improved engagement is due to extra bite of slips or extra compression of seals of the tool permitted by the swaging system 10 disclosed. It should be noted that based on the dimensional limitations created by the tool in the area where the second swage 26 is attempting to increase dimensionally, the second swage 26 might not extend fully to the second swage dimension 28. In such a case, however, an expansion force of the second swage 26 may still increase providing additional biting of slips or seating of seals as described above.

It should be noted that several parameters regarding the swaging system 10 might be set to meet desired characteristics. For example, a length of the increased dimension swage can be controlled by setting the length of the area of strength 30, 42, 56 as described above. A dimension between the area of strength 30, 42, 56 and the increased dimension 28 can be set as desired by setting of a dimension between the first swage 22 and the second swage 26. Forces of resistance to swaging by the first swage 22 can be set by setting such things as dimensional and material properties of the components used to construct the areas of strength 30, 42, 56 and the dimensional change of the tubular 14 that the first swage 22 will perform, for example. Additionally, adjustment of the second swage dimension 28 of the second swage 26 can be set to adjust at the resistance forces encountered by the first swage 22 by the teachings disclosed in '146.

Figure 6:
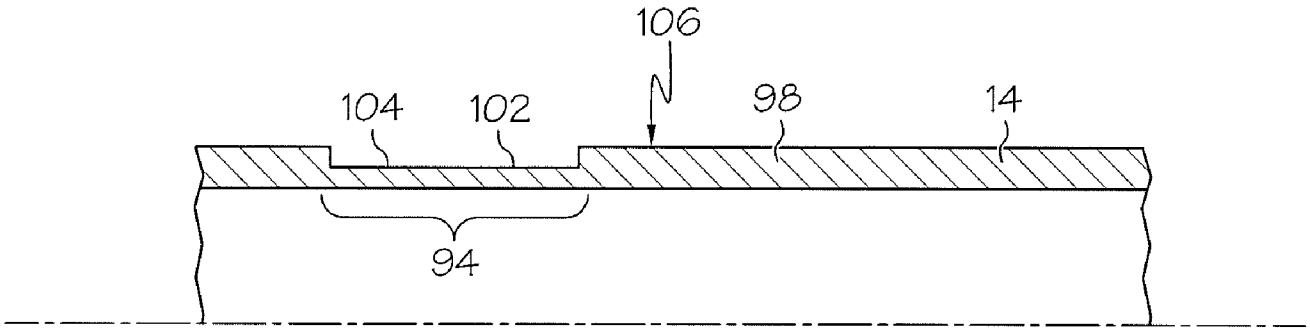
FIG. 6 depicts a partial cross sectional view of a tubular wall with an alternate area of strength.
Figure 7:
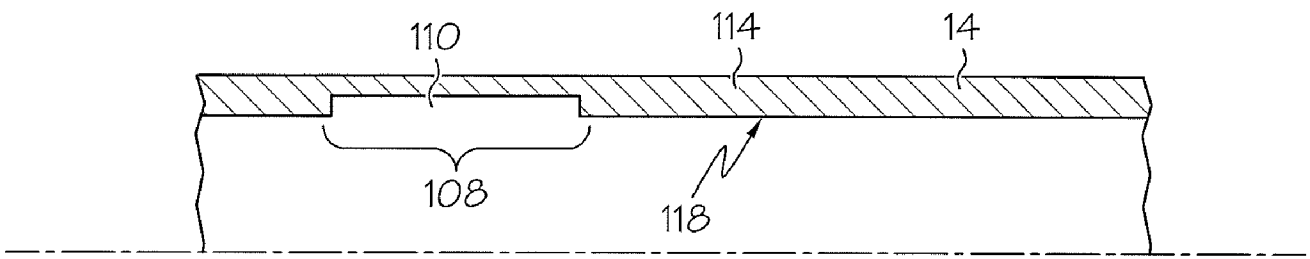
FIG. 7 depicts a partial cross sectional view of a tubular wall with yet another alternate area of strength.

Referring to FIGS. 6 and 7, alternate embodiments of the tubular 14 are disclosed. Unlike earlier embodiments that had an area of strength with an increase resistance to swaging, the embodiments of FIGS. 6 and 7 have area of strength with a decrease in resistance to swaging. The tubular 14, of FIG. 6, includes an area of strength 94 that has a wall 98 of the tubular 14 with an area of decreased thickness 102. The area of decreased thickness 102 results from a recess 104, in this embodiment, in an outer surface 106 of the wall 98. Alternately, the embodiment of FIG. 7 has an area of strength 108 with an area of decreased thickness 110 of wall 114 on an inner surface 118. In still other embodiments the area of strength could have changes to a wall thickness on both an inner surface as well as an outer surface simultaneously. In either of the areas of strength 94, 108, the walls 98, 114 are weakened thereby creating a localized decrease in resistance to swaging by the first swage 22. This decrease in resistance to swaging by the first swage 22 can result in a decrease in the second swage dimension 28, thereby leaving a specific feature in the walls 98, 114 that can be interfaced with a tool as will de detailed below.

Figure 8:
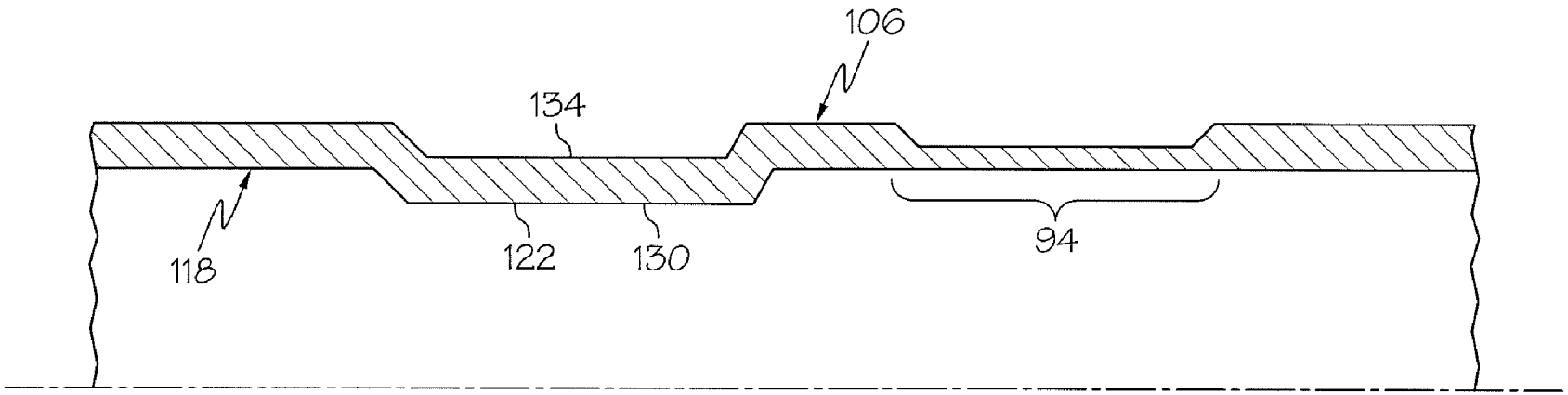
FIG. 8 depicts a partial cross sectional view of the tubular of FIG. 6 after the swaging tool has passed therethrough.

Referring to FIG. 8, a profile 122, of the inner surface 118 of the tubular 14, may be present after the swaging tool 18 has passed therethrough. The profile 122 may have a perimetrical protrusion 130 in the inner surface 118. The protrusion 130 is similar in length to a length of the area of strength 94 since the area of strength 94 caused the swaging tool 18 to form the protrusion 130. The protrusion 130 can be used to receive a retrieving tool, a hanger or other tool, for example, that needs a protrusion with which to interface. The profile 122, present on the inner surface 118, may be the same profile regardless of the areas of strength 94 or 108 employed in the swaging system 10. Additionally, a perimetrical recess 134 in the outer wall 106 may be formed by the swaging system disclosed herein that can be engaged with a tool that needs the recess 134 in the outer surface 106 to interface with.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole swaging system, comprising;

a tubular having an area of strength, the area of strength having a different resistance to swaging as compared to areas of the tubular outside of the area of strength; and a swaging tool comprising;

a first swage; and a second swage having an adjustable swaging dimension, the second swage being in functional communication with the first swage such that the adjustable swaging dimension is adjusted while swaging in response to the first swage encountering a change in resistance to swaging thereby, the adjustment being an increase in dimension when the change in resistance increases and a decrease in dimension when the change in resistance decreases.

2. The downhole swaging system of claim 1, wherein the area of strength includes a load ring positioned coaxial with the tubular.

3. The downhole swaging system of claim 2, wherein the load ring is positioned radially outwardly of the tubular.

4. The downhole swaging system of claim 1, wherein the area of strength includes a change in wall thickness of the tubular.

5. The downhole swaging system of claim 4, wherein the change in wall thickness includes a thickening of the wall in a radially inwardly direction.

6. The downhole swaging system of claim 1, wherein the area of strength includes a change in material properties of the tubular.

7. The downhole swaging system of claim 1, wherein the second swage is positioned behind the first swage in the direction of motion of the swage tool while swaging.

8. The downhole swaging system of claim 1, wherein the area of strength is located near a downhole tool such that the adjustment of the dimension of the second swage occurs at the downhole tool.

9. The downhole swaging system of claim 8, wherein the downhole tool is a packer.

10. The downhole swaging system of claim 9, wherein the packer includes slips the engagement force of which to a downhole structure is increased by the adjusted dimension of the second swage.

11. The downhole swaging system of claim 9, wherein the packer includes seals the engagement force of which to a downhole structure is increased by the adjusted dimension of the second swage.

12. The downhole swaging system of claim 1, wherein the first swage has a fixed swaging dimension.

13. The downhole swaging system of claim 1, wherein the adjustable dimension is circular.

14. A method of swaging a tubular, comprising:

positioning an adjustable dimension two staged swaging tool within a tubular;

swaging the tubular; and adjusting while swaging a dimension of a second stage of the adjustable dimension two staged swaging tool in response to encountering a change in resistance to swaging of the tubular with a first stage of the adjustable dimension two staged swaging tool, an increase in the change in resistance to swaging causing the adjusting to increase the dimension and a decrease in the change in resistance to swaging causing the adjusting to decrease the dimension.

* * * * *